US008733041B2

(12) United States Patent
Phipps

(10) Patent No.: US 8,733,041 B2
(45) Date of Patent: May 27, 2014

(54) WINDOW INSERT SYSTEM AND ASSOCIATED METHODS

(76) Inventor: Brian Phipps, Miramar, FL (US)

( * ) Notice: Subject to any disclaimer, the term of this patent is extended or adjusted under 35 U.S.C. 154(b) by 244 days.

(21) Appl. No.: 13/224,788

(22) Filed: Sep. 2, 2011

(65) Prior Publication Data

US 2012/0055106 A1 Mar. 8, 2012

Related U.S. Application Data

(60) Provisional application No. 61/380,472, filed on Sep. 7, 2010.

(51) Int. Cl.
*E04B 7/00* (2006.01)

(52) U.S. Cl.
USPC ..... 52/204.591; 52/204.7

(58) Field of Classification Search
USPC ..... 52/455, 204.591, 204.597, 204.62, 52/204.7, 204.71, 204.72
See application file for complete search history.

(56) References Cited

U.S. PATENT DOCUMENTS 4,156,988 A * 6/1979 Grover et al. ..... 49/390
4,599,833 A * 7/1986 Bullock ..... 52/127.5
4,920,718 A * 5/1990 Artwick et al. ..... 52/476
5,018,330 A * 5/1991 Lewkowitz ..... 52/455
5,133,168 A * 7/1992 Neilly et al. ..... 52/204.5
5,249,403 A * 10/1993 Neilly et al. ..... 52/204.5
5,497,588 A * 3/1996 Martin et al. ..... 52/208
5,570,548 A * 11/1996 Hopper ..... 52/204.5
5,636,484 A * 6/1997 DeBlock ..... 52/204.5
5,644,881 A * 7/1997 Neilly ..... 52/455
5,749,184 A * 5/1998 McKann ..... 52/204.1
5,765,325 A * 6/1998 DeBlock ..... 52/204.5
5,803,145 A * 9/1998 Lamb ..... 160/90
5,894,706 A * 4/1999 Herbst ..... 52/782.1
6,151,849 A * 11/2000 Twigg et al. ..... 52/208
6,272,801 B1 * 8/2001 Suh ..... 52/211
6,318,037 B1 * 11/2001 Hansen ..... 52/208
6,467,226 B2 * 10/2002 Dodson et al. ..... 52/220.1
6,546,682 B1 * 4/2003 DeBlock et al. ..... 52/204.72
6,574,935 B2 * 6/2003 Wang Chen ..... 52/455
6,618,998 B1 * 9/2003 Thomas et al. ..... 52/63
6,694,701 B2 * 2/2004 Wang et al. ..... 52/783.1
6,715,245 B2 * 4/2004 Lewkowitz ..... 52/208
6,763,647 B2 * 7/2004 Yeany ..... 52/786.1
6,925,767 B2 * 8/2005 Krochmal et al. ..... 52/455
6,931,810 B2 * 8/2005 Beaudoin et al. ..... 52/455
7,104,015 B2 * 9/2006 Huynh ..... 52/208
7,448,174 B2 * 11/2008 Krochmal et al. ..... 52/204.54
2002/0059758 A1 * 5/2002 Dodson et al. ..... 52/204.1
2003/0041539 A1 * 3/2003 Bernacki et al. ..... 52/204.54

(Continued)

*Primary Examiner* — William Gilbert
*Assistant Examiner* — James Ference
(74) *Attorney, Agent, or Firm* — Mark R. Malek; Daniel C. Pierron; Zies Widerman & Malek

(57) ABSTRACT

A window insert system that advantageously provides a high strength mounting system for windows to be positioned within an opening is provided. The window insert system for mounting the window into a an opening formed in a door or other structural element includes a mounting channel connected to a door or other structural element, a window rail to overlie the mounting channel and support a window therein, and a window securing member to engage a portion of the window rail to secure the window. The window rail may include an outer surface portion, an inner sidewall, an exterior sidewall, and a window carrying member. The window may be positioned between the window carrying member and the window securing member.

16 Claims, 4 Drawing Sheets

(56) References Cited

U.S. PATENT DOCUMENTS

2003/0056442 A1* 3/2003 Gerard ..... 49/504
2004/0144046 A1* 7/2004 Wang et al. ..... 52/204.1
2007/0193140 A1* 8/2007 Carnick et al. ..... 52/208
2008/0245003 A1* 10/2008 Kon et al. ..... 52/208
2010/0064625 A1* 3/2010 Charlton et al. ..... 52/656.4
2010/0229500 A1* 9/2010 Lynch et al. ..... 52/784.13

* cited by examiner

WINDOW INSERT SYSTEM AND ASSOCIATED METHODS

RELATED APPLICATIONS

This application is related to and claims the benefit of U.S. Provisional Patent Application Ser. No. 61/380,472 titled WINDOW INSERT SYSTEM AND ASSOCIATED METHODS filed on Sep. 7, 2010, the entire contents of which are incorporated herein by reference.

FIELD OF THE INVENTION

The present invention relates to the field of windows and, more particularly, to the field of inserts to be carried by doors or other exterior structural elements that allow for ready installation of windows into doors, and associated methods.

BACKGROUND OF THE INVENTION

It is often desired to insert a functional window into a pre-constructed door or other external structural element such as, for example, a garage door or wall. When inserting a window into such a structural element, it is important that the window is securely carried by the structural element to ensure that the window can properly withstand various environmental elements such as, for example, hurricane force winds. When an opening is cut out in a door or other structural element to install a window, the structural integrity may be jeopardized and should be reinforced. This may especially be true when installing impact resistant windows. Impact resistant windows may not be effective if an insert, such as a frame, fails even if the window maintains its integrity.

There exist various structural elements for carrying a window in a door or other structural element. For example, U.S. Pat. No. 4,599,833 to Bullock discloses an insert retainer for securing a door insert such as a window or screen unit within a door frame. The insert includes a one-piece flexible strip having a generally flat first web portion, a second web portion which extends from one end of the first web portion perpendicular thereto, and a third web portion forming a channel with the first and second web portions. The insert also includes an arcuate integral hinge forming an extension of the second web portion, and an end portion extending outwardly from the integral hinge at an acute angle to the second web portion. The end portion is arranged to be tightly received within a channel formed in the door and adapted to compress the integral hinge about a bead forming a part of the channel construction. While the insert of the Bullock '833 patent allows for ease of insertion and removal, it fails to provide improved or maintained structural integrity of the door.

U.S. Pat. No. 4,156,988 to Grover et al. discloses an air-water sealing system for metal windows. An extruded aluminum is provided with outer frame members for fastening to a building and inner frame members for fastening and holding one or more glass panes. The frames are provided with a sealing system which, while allowing pressure equalization, prevents air and moisture from passing into the interior of the structure when the window is closed. The sealing system includes an external water deterrent and a pair of internal sealing members with the frame between the external deterrent and the internal sealing members having a water barrier formed with a plurality of serrations, each in a plane parallel to the frames. The sill of the outer window frame is provided with internal and external upwardly extending legs, and a raised central portion which joins the external leg in a recessed gutter to drain water out through slots in the external leg. The Grover et al. '988 patent, however, fails to provide an uncomplicated installation process that may easily be performed on any door or other structural element.

U.S. Pat. No. 5,497,588 to Martin et al. discloses a decorative overlay and window system for an opening in a garage door. This system allows a user to insert a decorative overlay into an opening formed in a garage door. The overlay is adapted to matingly engage a frame in the garage door. While the Martin et al. '588 patent does provide for ease of installation, it fails to provide for insertion into any type of door other than a garage door. Further, the Martin et al. '588 patent is largely decorative, without any opening or closing function for the window.

There exists a need to provide a window insert suitable for inserting a functional window into a door or other structural element that allows for the window to be securely carried by the door or other structural element such that, when cutting the opening to install or insert the window, the structural integrity of the window, door, or other structural element cannot be jeopardized and must be reinforced.

SUMMARY OF THE INVENTION

With the foregoing in mind, it is therefore an object of the present invention to, provide a window insert system that has high strength properties to withstand damaging environmental effects such as, for example, hurricane force winds. It is also an object of the present invention to provide a window insert system that is uncomplicated to install and that minimizes the amount of necessary loose parts for installation.

These and other objects, features and advantages according to the present invention are provided by a window insert system comprising a mounting channel to be connected to a door and a window flange to overlie the mounting channel. The window flange may include an outer surface portion, an inner sidewall extending outwardly from the outer surface portion, an exterior sidewall positioned opposite the inner sidewall and extending outwardly from the outer surface portion, and a window carrying member connected to and extending outwardly from the outer surface portion. The window insert system may also include a window securing member to engage a portion of the window flange to secure a window. The window may be positioned between the window carrying member and the window securing member. A passageway may be formed in the outer surface portion of the window flange to receive a mounting member.

The mounting channel may include an outer surface portion and an interior sidewall extending outwardly from the outer surface portion. The interior sidewall may include an interior trim engaging member. The mounting channel may also include an exterior sidewall positioned opposite the interior sidewall and extending outwardly from the outer surface portion. The exterior sidewall may include an exterior trim engaging member.

The window insert system may further comprise a first trim member to engage the exterior trim engagement member, and a second trim member to engage the interior trim engagement member. The trim member may include an outer surface portion, sidewalls extending outwardly from the outer surface portion, and a trim engagement receiving member connected to and extending outwardly form the outer surface portion. The outer surface portion of each of the trim engagement members may be ribbed, and an inner surface portion of each of the trim engagement receiving members may be ribbed. The trim member, the mounting channel, and the window flange may each be integrally formed as a monolithic unit.

Accordingly, each of the components of the window insert system may be easy to manufacture.

The exterior sidewall of the window flange may overlie the exterior sidewall of the mounting channel when the window flange overlies the mounting channel. The inner sidewall of the window flange may abut the outer surface portion of the mounting channel when the window flange may overlie the mounting channel. One of the sidewalls of the first trim member may overlie the exterior sidewall of the window flange when the first trim member engages the exterior trim engagement member of the mounting channel. One of the sidewalls of the second trim member may overlie the inner sidewall of the window flange when the second trim member engages the interior trim engagement member of the mounting channel.

A method aspect of an embodiment of the present invention is for using a window insert system to mount a window to an opening formed in a door. The method may comprise connecting the mounting channel to the door, positioning the window flange to overlie the mounting channel, and driving a mounting member through the window flange, the mounting channel, and the door.

DETAILED DESCRIPTION OF THE PREFERRED EMBODIMENT

Figure 1A:
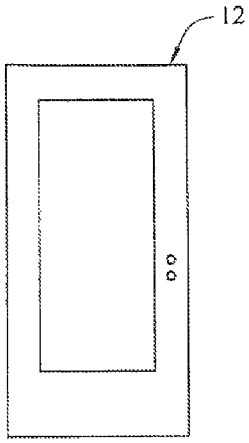
FIGS. 1A-1F are a series of various views of a door illustrating the process of installing a window into the door using the window insert system according to the present invention.

The present invention will now be described fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art will realize that the following embodiments of the present invention are only illustrative and are not intended to be limiting in any way. Other embodiments of the present invention will readily suggest themselves to such skilled persons having the benefit of this disclosure. Like numbers refer to like elements throughout. Prime notations, when used, refer to like elements in alternate embodiments of the invention.

The window insert system 10 according to the present invention may advantageously allow a user to insert a quality window 14 in an exterior door 12. It is preferred that the window insert system 10 according to the present invention be used to insert a window 14 into a standard 1¾" exterior door 12, but those having skill in the art will appreciate that the system may advantageously be adapted to insert a window 14 into any size door, and may further be adapted to insert a window into an exterior door, an interior door, or any structural element. As will be discussed in greater detail below, the window insert system 10 may include a mounting channel 16 that may act as a mounting bracket as well as an inner stile which may attach a window 14 to a door 12 through standard mounting holes of the window 14. This mounting channel 16 may be designed to add structural rigidity to the door 12 for increased design pressures required by many building codes. This is especially advantageous in geographical regions that may be exposed to environmental factors such as, for example, hurricane force winds. A skilled artisan will readily appreciate, however, that adding structural rigidity to a door 12 can be advantageous for any number of building codes instituted due to other environmental factors including, but not limited to, earthquakes and tornadoes. The window insert system 10 according to an embodiment of the present invention may also advantageously provide easy installation of a variety of windows 14 with an aesthetically pleasing finished appearance.

Figure 1B:
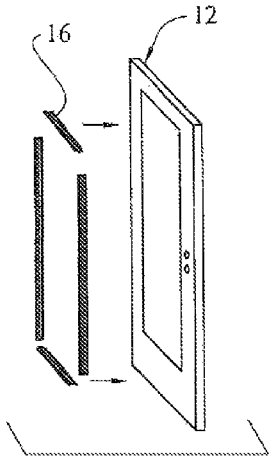
Figure 1C:
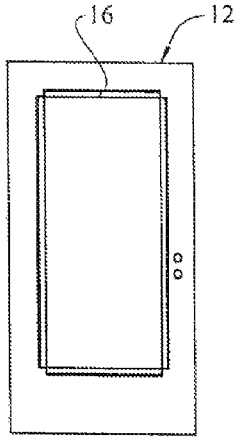
Figure 1D:
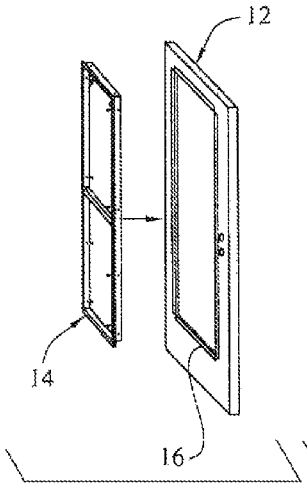
Figure 1E:
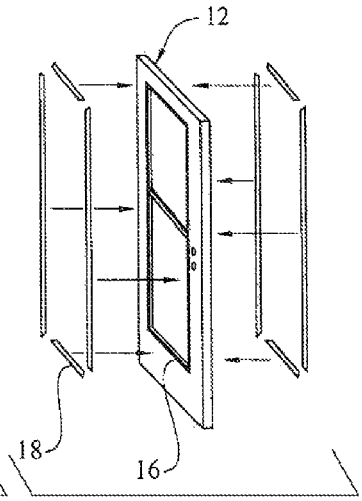
Figure 1F:
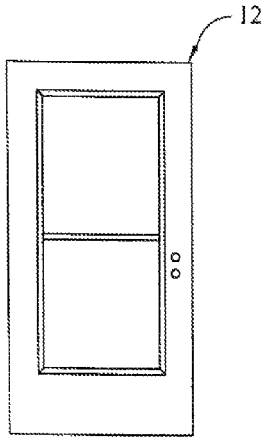

One problem that has arisen in the design of mounting systems for windows is that the mounting system may sometimes fail prior to the window failing. In other words, with the advent of hurricane windows and impact resistant windows, that are generally capable of withstanding great impacts that may occur during environmental events such as, for example, a hurricane or a tornado, although the glass in the window may be able to withstand such an impact, many times, the connection between the window and the opening formed in the door, or other structural element cannot withstand the force of the impact, causing the entire window to be separated from the opening in the door, which may result in storm damage to the interior of the structure. This problem is solved by the window insert system 10 according to an embodiment of the present invention, which advantageously provides a strong connection between the window and the opening formed in the door or other structural element. The window insert system 10 according to an embodiment of the present invention provides for Referring initially to FIGS. 1A-1F, various views of a door 12 are illustrated showing phases of the window insert system 10 being used to insert a window 14 into an opening formed in the door. FIG. 1A depicts a front elevation view of a door 12 having a cut-out adapted to receive a window 14 using the window insert system 10 according to an embodiment of the present invention. FIG. 1B is a side perspective view of the door 12 showing a mounting channel 16 being inserted into a door opening. FIG. 1C is a front elevation view of the door 12 showing the mounting channel 16 inserted into the opening in the door. FIG. 1D is a side perspective view of the door 12 showing the window 14 being inserted into the opening in the door so that the window is carried by the mounting channel 16 already connected to the door. FIG. 1E is a side perspective view of the door 12 showing a plurality of trim members 18 being connected to front and rear portions of the door. Finally, FIG. 1F is a front elevation view of the door 12 having a window 14 inserted into an opening therein using the window insert system 10 according to the present invention.

Figure 2:
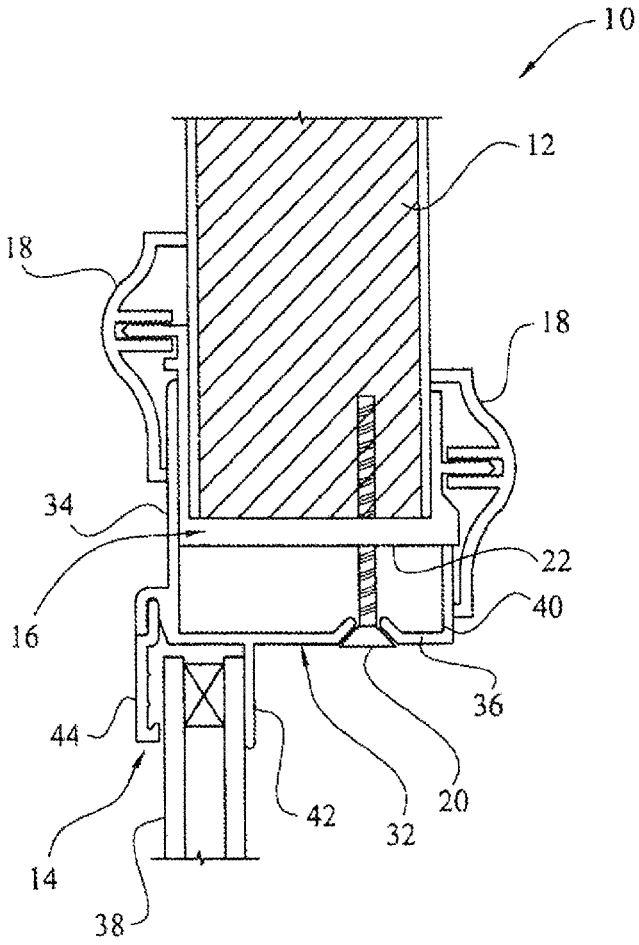
FIG. 2 is a cross sectional view of a door having the window insert system according to the present invention installed thereon and carrying a window having portions cut away.
Figure 3:
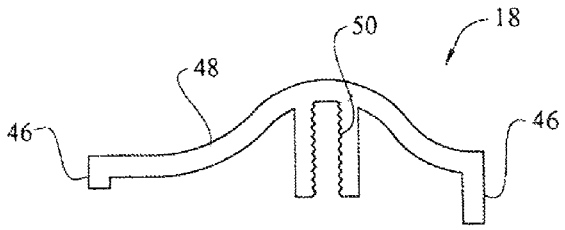
FIG. 3 is a plan view of a trim member of the window insert system illustrated in FIG. 2.

Referring now additionally to FIG. 2, additional features of the window insert system 10 according to the present invention are now described in greater detail. The window insert system 10 illustratively includes a mounting channel 16 that may be adapted to be connected to a door 12. The mounting channel 16 is illustrated in greater detail in FIG. 4. The mounting channel 16 may illustratively include an outer surface portion 22, an exterior sidewall 24 which extends upwardly from the outer surface portion, and an interior sidewall 26 which extends upwardly from the outer surface portion and preferably positioned opposite the exterior sidewall. The outer surface portion 22, the exterior sidewall 24 and the interior sidewall 26 are preferably integrally formed as a monolithic unit to form the mounting channel 16. One skilled in the art will readily appreciate the advantages inherent in manufacturing the outer surface portion 22, the exterior sidewall 24, and the interior sidewall 26 as a monolithic unit. The skilled artisan will note, however, that the outer surface portion 22, the exterior sidewall 24, and the interior sidewall 26 may also be manufactured in pieces which may be assembled to create a mounting channel 16. The space between the opposing facing walls of the exterior sidewall 24 of the mounting channel 16 and the interior sidewall 26 of the mounting channel is preferably dimensioned slightly larger than the thickness of the door 12 so that the mounting channel may readily engage the door when an opening, which may receive the window 14, is formed.

Figure 4:
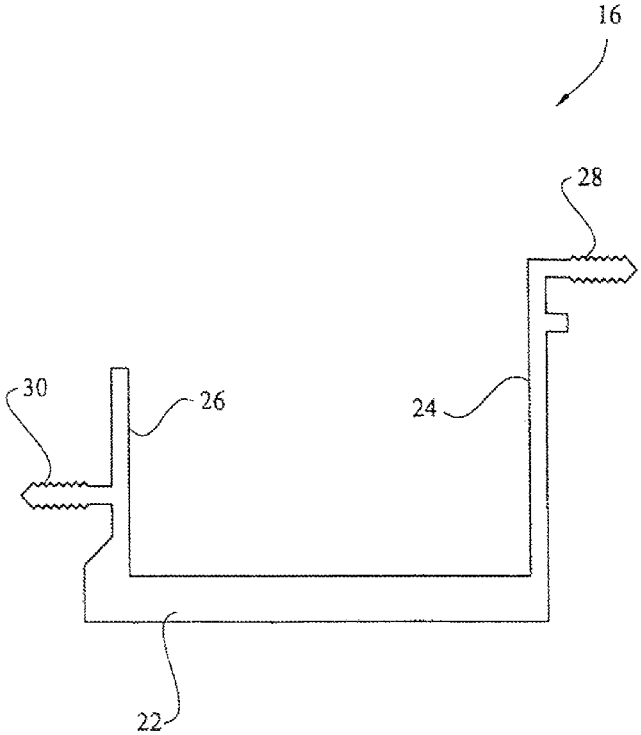
FIG. 4 is a plan view of a mounting channel of the window insert system illustrated in FIG. 2.

Referring now to FIG. 4, the mounting channel 16 may also include an exterior trim engaging member 28 that preferably extends outwardly from the exterior sidewall 24 and an interior trim engaging member 30 that preferably extends outwardly from the interior sidewall 26. The exterior trim engaging member 28 and the interior trim engaging member 30 may preferably be integrally formed as a monolithic unit along with the exterior sidewall 24, the interior sidewall 26, and the outer surface portion 22 of the mounting channel 16. In other words, the mounting channel 16 as depicted in FIG. 4 may be integrally formed as a monolithic unit. As indicated above, however, the individual portions of the mounting channel 16, i.e., the outer surface portion 22, the exterior sidewall 24, the interior sidewall 26, the exterior trim engagement member 28, and the interior trim engagement member 30 may also be individually formed and connected to one another to form a single mounting channel 16, as understood by those skilled in the art.

Each of the exterior and interior trim engagement members 28, 30 may be elongate and may include serrations (or ribs) formed therein. The serrations in the exterior and interior trim engagement members 28, 30 may be adapted to engage the trim members (as will be discussed in greater detail below) to readily connect the trim member 18 to the mounting, channel 16 to thereby keep a window 14 in place in the opening formed in the door 12. The mounting channel 16 may preferably be made of an aluminum material, but those skilled in the art will appreciate that any type of material having similar strength properties may also be acceptable to form the mounting channel 16.

Referring back to FIG. 2, installation of the mounting channel 16 is now described in greater detail. The shape of the mounting channel 16 may advantageously allow it to be matingly connected to a door 12. As illustrated, for example, in FIG. 1B, the mounting channel 16 may be provided in four separate and elongate pieces. These four separate pieces may be aligned with the respective top portion, bottom portion and side portions of the opening that is formed to receive the window 14. The skilled artisan will readily appreciate the advantages of providing the mounting channel 16 in four separate and elongate pieces, and will also appreciate the advantages of providing the mounting channel 16 in more or fewer pieces, for example, two, eight, or ten pieces. The suggestion of providing the mounting channel 16 in four pieces is offered as an example, and is not meant to be limiting in any way. The mounting channel 16 may preferably have an internal width, i.e., width measured between the exterior and the interior sidewalls 24, 26 of the mounting channel, that is slightly larger than the thickness of the door 12 so that, the mounting channel may be readily matingly connected to the door and so that the exterior and interior sidewalls of the mounting channel engage the respective exterior sidewall of the door and the interior sidewall of the door as illustrated, for example, in FIG. 2.

As illustrated, for example, in FIG. 2, the window 14 may include a window rail 32 connected thereto. In many cases, the window rail 32 may be referred to as a window flange. Those skilled in the art may also refer to an exterior sidewall 34 (described below) of the window rail 32 as the window flange. The use of this terminology is not meant to limit the structure of the window rail 32 in any way. The window rail 32 may include an outer surface portion 36 and an exterior sidewall 34 extending outwardly from the outer surface portion. The window rail 32 also illustratively includes an inner sidewall 40, which may be connected to the outer surface portion 36 and positioned opposite the exterior sidewall 34. The window 14 may include a glass portion 38 that is carried between a window carrying member 42 which may be adapted to extend outwardly from the window rail 32. The window 14 may also include a window securing member 44 that may be adapted to engage a portion of the exterior sidewall 34 of the window rail 32 and may engage a portion of the glass portion 38 which may secure the glass portion 38 to the window carrying member 42. The outer surface portion 34 of the window rail 32 may also include a passageway formed therein which may receive a mounting member 20. The outer surface portion 36, exterior sidewall 24, inner sidewall 40, and window carrying member 42 may preferably be integrally formed as a monolithic unit. Those skilled in the art will appreciate, however, that the individual portions of the window rail 32, i.e., the outer surface, portion 36, the exterior sidewall 24, the inner sidewall 40, and the window carrying member 42, may also be individually formed and connected to one another to form a single window rail 32.

After the mounting channel 16 is connected to the door 12, the window 14 may now be ready to be inserted into the opening in the door 12 having the mounting channel 16 connected thereto. This may be performed by setting the window rail 32 into the opening so that the exterior sidewall 34 of the window rail 32 may overlie the exterior sidewall 24 of the mounting channel 16, and so that the outer surface portion 36 of the window rail 32 may overlie the outer surface portion 22 of the mounting channel 16, such that the inner sidewall 40 of the window rail 32 may abut the outer surface portion 22 of the mounting channel 16. After the window rail 32 has been set, a plurality of mounting members 20 may be passed through the passageway formed in the outer surface portion 36 of the window rail 32 to secure the window rail 32 (thereby securing the window as well) to the door 12. Although not illustrated, it is understood that a passageway may be formed in the outer surface portion 22 of the mounting channel 16 so that the mounting member 20 may readily pass through the mounting channel 16 and into the door 12 to secure the window rail 32 to the mounting channel 16, and to secure the mounting channel 16 to the door 12. A skilled artisan will readily appreciate the ease of use provided by the formation of such a passageway. The presence of such a passageway is merely an example, however, and not intended to be limiting in any way. The mounting members 20 may advantageously be provided by screws, for example, but those skilled in the art will appreciate that any type of fastener may also be used while accomplishing the goals, features, advantages, and benefits of the present invention.

After the mounting channel 16 is mounted to the opening formed in the door 12, and after the window 14 is mounted to the mounting channel, the trim members 18 illustrated in FIG.

3 may be connected to complete installation of the window 14 using the window insert system 10 according to the present invention. More specifically, the trim members 18 may illustratively include an outer surface portion 48 and sidewalls 46 which may extend outwardly from the outer surface portion. The trim member 18 may also illustratively include a trim engagement receiving member 50 that may be connected to and extend outwardly from the outer surface portion 48. The trim engagement receiving member 50 may be adapted to receive the exterior and interior trim engagement members 28, 30 of the mounting channel 16. Similar to the exterior and interior trim engagement members 28, 30 of the mounting channel 16, the trim engagement receiving member 50 may also be serrated (or ribbed) to form a secure connection therebetween. The outer surface portion 48, sidewalls 46, and trim engagement receiving member 50 may preferably formed as a monolithic unit. Those skilled in the art will appreciate, however, that the individual portions of the trim member 18, i.e., the outer surface portion 48, sidewalls 46, and trim engagement receiving member 50 may also be individually formed and connected to one another to form a single trim member 18. Accordingly, upon mounting the window 14 to the mounting channel 16, installation of the window may be completed by securing the trim member 18 to both the exterior portion of the mounting channel 16 along the exterior trim engagement member 28 and the interior portion of the mounting channel 16 along the interior trim engagement member 30. This may be accomplished by positioning a first trim member 18 such that one of its sidewalls 46 may overlie the exterior sidewall 34 of the window rail 32 when the first trim member 18 engages the exterior trim engagement member 28 of the mounting channel 16, and positioning a second trim member 18 such that one of its sidewalls 26 may overlie the inner sidewall 40 of the window rail 32 when the second trim member 18 engages the interior trim engagement member 30 of the mounting channel 16.

The window insert system 10 according to the present invention advantageously allows for a window 14 to be readily inserted into an opening formed in a door 12 or other structural element using a mounting channel 16 that may be readily connected to an opening formed in the door 12. The window insert system 10 according to an embodiment of the present invention may further use a trim member 18, which may advantageously provide an aesthetically pleasing appearance of an installed window 14 that may achieve the requirements of building codes.

Referring now back to FIG. 1, installation of the window insert system 10 according to the present invention will now be described in greater detail. As illustrated, for example, in FIG. 1A, an opening is cut into the door 12. The opening is preferably 7/16" larger in height and width than the specifications of the window size that has been chosen to be inserted into the door 12. The mounting channel 16 may inserted into the opening of the door 12 by sliding the top and bottom portions of the mounting channel 16 onto the door 12 first, followed by the side portions of the mounting channel 16, as illustrated, for example, in FIGS. 1B and 1C. The window 14 is then positioned into the opening by setting the window rail 32 along the mounting channel 16. The window 14 is secured using the mounting members 20, as illustrated, for example, in FIG. 1D. After mounting the window 14, it is preferable that a sealant, such as a silicone sealant, for example, be positioned around the window rail 32 at the seam between the window rail and the mounting channel 16 along an exterior portion of the door 12. It is also preferable that the sealant be applied to all four corners of the mounting channel 16 to eliminate water infiltration. One skilled in the art will readily appreciate the benefits of using such a sealant, as well as other sealants. However, a skilled artisan will also note that such a sealant may not ultimately be necessary, and therefore should not be construed as limiting in any way. Finally, the trim member 18 may be mounted by engaging the trim engagement receiving member 50 to the exterior and interior trim engagement members 28, 30 to provide a finished appearance of the inserted window 14.

Figure 5:
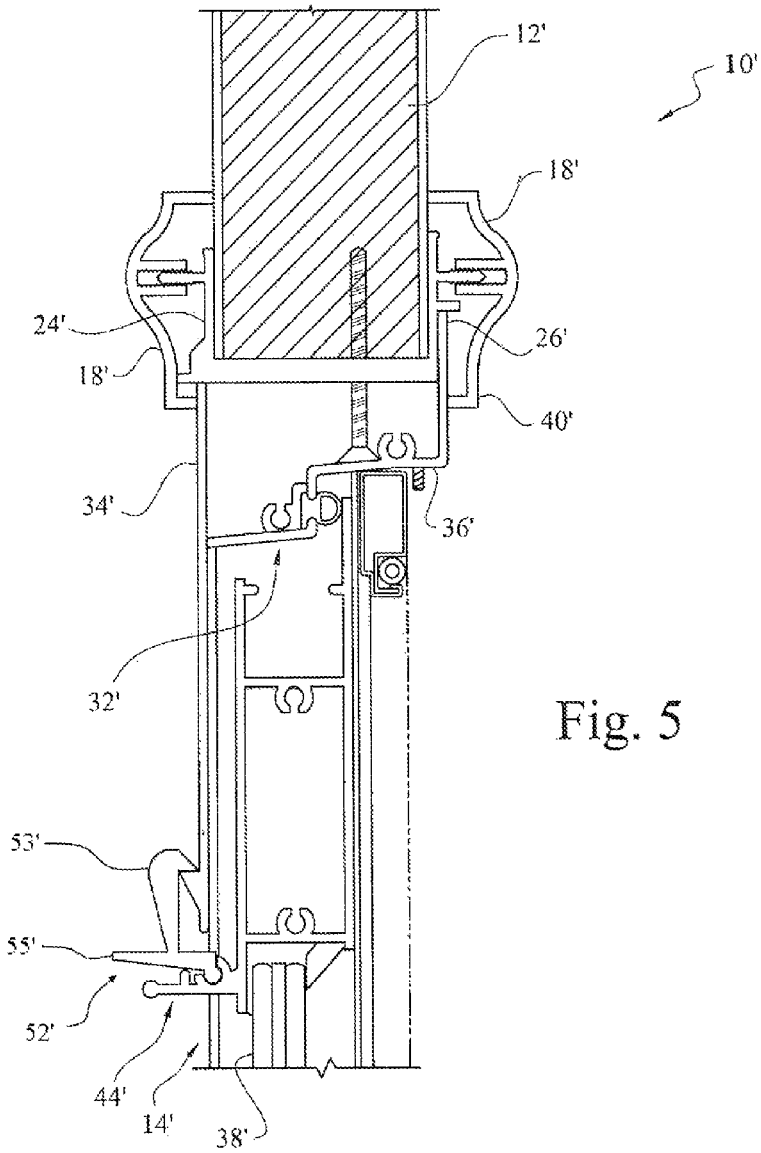
FIG. 5 is cross sectional view of a door having another embodiment of the window insert system according to the present invention installed thereon and carrying a window having portions cut away.

Referring now to FIG. 5, additional features of an embodiment of the window insert system 10' according to the present invention is now described in greater detail. The window insert system 10' according to the illustrated embodiment of the present invention includes a mounting channel 16', a window rail 32' and trim members 18' that engage the mounting channel so that portions thereof overlie both the mounting channel and the window rail. Additionally, the window insert system 10' may include various elements that are substantially similar to analogous elements as described hereinabove for previous embodiments, including, but not limited to, an outer surface portion 22', exterior sidewall 24', and interior sidewall 26' of the mounting channel 16', an exterior trim engaging member 28', an interior trim engaging member 30', and an outer surface portion 36' and inner sidewall 40' of the window rail 32'. The window rail 32' has an alternate shape from the other illustrated embodiments of the window rail 32 illustrated in FIGS. 1-4, and described above, but those skilled in the art will appreciate that this embodiment of the window rail 32' accomplishes a substantially similar function. The window rail 32' of the window insert system 10' illustrated, for example, in FIG. 5 is preferably used in connection with windows 14' that have a sliding feature. These may, for example, be windows 14' that have a first portion that remains stationary, and a second portion that slides with respect to the first portion so that the window 14' may be moved between an opened position and a closed position.

Those skilled in the art will appreciate that the window rail 32' used in connection with such a window 14' may be connected to the window 14' during manufacture of the window. In the illustrated embodiment of the window insert system 10', the glass 38' of the window 14' is connected to a window securing member 44', and the window securing member 44' is connected to the window rail 32' using a slide receiving member 52'. More specifically, the window securing member 44' may include a slide receiving member connector 54' that slidably engages the slide receiving member 52' so that one portion of the window may slide with respect to another portion of the window.

The slide receiving member 52' has a front surface portion 53' and a side portion 55' that connects to and extends outwardly from the front surface portion. The slide receiving member 52' is adapted to engage the window securing member 44' and the exterior wall 34' (also known as the flange) of the window rail 32' to slidably connect portions of the window 14', i.e., the glass 38', for example, to the window rail. Those skilled in the art will appreciate that when reference is made to the window 14', many components illustrated in FIG. 5, for example, may be included during the manufacture of the window. Alternately, many of these components may be connected to the glass 38' portion of the window 14' separately. For example, during the manufacturing process, the glass 38' may be connected to the window securing member 44', and the window securing member may be connected to the window rail 32' using the slide receiving member 52' so that a sliding window is produced. This configuration is advantageous when using the window insert system 10' of the present invention in that the window 14' having slidable glass 38' portions, i.e., slidable with respect to one another, may be readily mounted within an opening formed in a door 12', or other structural element, by engaging the window rail 32' with the mounting channel 16'.

Those skilled in the art will further appreciate that many of the components mentioned above may be connected to the glass 38' of the window during a separate process. Fore example, embodiments of the present invention contemplate that the glass 38' of the window 14' may be connected to the window securing member 44' during manufacture, and that the glass having he window securing member connected thereto may then be connected to the window rail 16' using the slide receiving member 52', so that the window can thereafter be mounted within the opening formed within the door 12'. Those skilled in the art will further appreciate that any combination of manufacturing options are available, have been contemplated by embodiments of the present invention, and are intended to be included in the scope and spirit of the present invention.

Use of this embodiment of the window insert system 10' is similar to sue of the previously described embodiments of the window insert system 10. More particularly, the mounting channel 16' is connected to the opening formed in the door 12' using a fastener 20' such as, for example, a mounting screw, as understood by those skilled in the art. The window 14' including the window securing member 44' that is connected to the window rail 32' using the slide receiving member 52' may then be positioned to overlie, or positioned adjacent to, the mounting channel. In other words, the window 14' may be positioned within the opening in the door 12' so that the four sides of the window engage the respective four sides of the opening to be positioned adjacent the mounting channel positioned within the opening. Thereafter, the trim members 18' may be connected adjacent both the interior and exterior surfaces of the window 14'. The trim members 18' include trim engagement receiving members that engage both the interior and exterior trim engagement members on the mounting channel 16'

Figure 6:
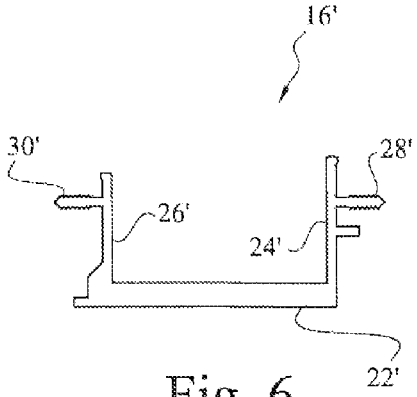
FIG. 6 is a plan view of another embodiment of a mounting channel of the window insert system illustrated in FIG. 5.

Referring now additionally to FIG. 6, an alternate embodiment of the mounting channel 16' is now described in greater detail. This embodiment of the mounting channel 16' is similar to the previously described embodiment of the mounting channel 16 (described above and illustrated in FIGS. 1-5), but having a slightly different shape. The mounting channel 16' of this embodiment functions similarly to the mounting channel 16 described above, is labelled with prime notation, and requires no further discussion herein.

This embodiment of the window insert system 10' advantageously allows for windows 14' having sliding portions to be readily secured within an opening formed in a door 12' or other structural element. This embodiment of the window insert system 10' also advantageously securely fastens the window 14' within the opening so as to enhance the strength of such a window, thereby meeting, and exceeding, the requirements of most building codes. The other elements of this embodiment of the window insert system 10' not specifically discussed above are labelled with prime notation, are similar to those elements of the window insert system 10 described above, and require no further discussion herein.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed. It is also understood that any mention of dimensions in either the specification or the drawings is merely exemplary and not limiting in nature.

That which is claimed is:

1. A window insert system comprising:

a mounting channel to be connected to a door, the mounting channel comprising:

an outer surface portion, an interior sidewall extending outwardly from the outer surface portion, the interior sidewall comprising an interior trim engaging member, and an exterior sidewall positioned opposite the interior sidewall and extending outwardly from the outer surface portion, the exterior sidewall comprising an exterior trim engaging member;

a window rail to overlie the mounting channel, the window rail comprising:

an outer surface portion, an inner sidewall extending outwardly from the outer surface portion, an exterior sidewall positioned opposite the inner sidewall and extending outwardly from the outer surface portion, and a window carrying member connected to and extending outwardly from the outer surface portion; and a window securing member to engage a portion of the window rail to secure a window;

wherein the window is positioned between the window carrying member and the window securing member.

2. The window insert system according to claim 1 wherein a passageway is formed in the outer surface portion of the window rail to receive a mounting member.

3. The window insert system according to claim 1 further comprising at least one trim member to engage the mounting channel.

4. The window insert system according to claim 3 wherein the at least one trim member comprises a first trim member to engage the exterior trim engagement member, and a second trim member to engage the interior trim engagement member.

5. The window insert system according to claim 3 wherein the at least one trim member comprises:

an outer surface portion, sidewalls extending outwardly from the outer surface portion, and a trim engagement receiving member connected to and extending outwardly from the outer surface portion.

6. The window insert system according to claim 5 wherein an outer surface portion of each of the trim engagement members is ribbed, and wherein an inner surface portion of each of the trim engagement receiving members is ribbed.

7. The window insert system according to claim 5 wherein the at least one trim member, the mounting channel, and the window rail are each integrally formed as a monolithic unit.

8. The window insert system according to claim 5:

wherein the exterior sidewall of the window rail overlies the exterior sidewall of the mounting channel when the window rail overlies the mounting channel;

wherein the inner sidewall of the window rail abuts the outer surface portion of the mounting channel when the window rail overlies the mounting channel;

wherein one of the sidewalls of the first trim member overlies the exterior sidewall of the window rail when the first trim member engages the exterior trim engagement member of the mounting channel; and wherein one of the sidewalls of the second trim member overlies the inner sidewall of the window flange when the second trim member engages the interior trim engagement member of the mounting channel.

9. A window insert system comprising:

a mounting channel to be connected to a door, the mounting channel comprising:

an outer surface portion, an interior sidewall extending outwardly from the outer surface portion, the interior sidewall comprising an interior trim engaging member, and an exterior sidewall positioned opposite the interior sidewall and extending outwardly from the outer surface portion, the exterior sidewall comprising an exterior trim engaging member;

a first trim member to engage the exterior trim engaging member and a second trim member to engage the interior trim engaging member, each of the first and second trim members comprising an outer surface portion, and sidewalls extending outwardly from the outer surface portion;

and a window rail to overlie the mounting channel, the window rail comprising:

an outer surface portion, an inner sidewall extending outwardly from the outer surface portion, an exterior sidewall positioned opposite the inner sidewall and extending outwardly from the outer surface portion, and a window carrying member connected to and extending outwardly from the outer surface portion, wherein the exterior sidewall of the window rail overlies the exterior sidewall of the mounting channel when the window rail overlies the mounting channel, wherein the inner sidewall of the window rail abuts the outer surface portion of the mounting channel when the window rail overlies the mounting channel, wherein one of the sidewalls of the first trim member overlies the exterior sidewall of the window rail when the first trim member engages the mounting channel, and wherein one of the sidewalls of the second trim member overlies the inner sidewall of the window rail when the second trim member engages the mounting channel.

10. The window insert system according to claim 9 further comprising a window securing member to engage a portion of the window rail to secure a window.

11. The window insert system according to claim 10 wherein the window is positioned between the window carrying member and the window securing member.

12. The window insert system according to claim 9 wherein a passageway is formed in the outer surface portion of the window rail to receive a mounting member.

13. The window insert system according to claim 9 wherein the first trim member engages the exterior trim engagement member, and wherein the second trim member engages the interior trim engagement member.

14. The window insert system according to claim 13 wherein each of the first and second trim members further comprises a trim engagement receiving member connected to and extending outwardly from the outer surface portion.

15. The window insert system according to claim 14 wherein an outer surface portion of each of the trim engagement members is ribbed, and wherein an inner surface portion of each of the trim engagement receiving members is ribbed.

16. The window insert system according to claim 9 wherein the trim members, the mounting channel, and the window rail are each integrally formed as a monolithic unit.

* * * * *